US007736180B1

(12) United States Patent
Paynter

(10) Patent No.: US 7,736,180 B1
(45) Date of Patent: Jun. 15, 2010

(54) INNER CONDUCTOR WEDGE ATTACHMENT COUPLING COAXIAL CONNECTOR

(75) Inventor: Jeffrey Paynter, Momence, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 12/411,792

(22) Filed: Mar. 26, 2009

(51) Int. Cl.
*H01R 9/05* (2006.01)

(52) U.S. Cl. ..... 439/578; 439/441; 439/863

(58) Field of Classification Search ..... 439/578, 439/584, 585, 882, 441, 863
See application file for complete search history.

(56) References Cited

U.S. PATENT DOCUMENTS

| | | | | |
|---|---|---|---|---|
| 4,698,031 | A * | 10/1987 | Dawson | 439/863 |
| 4,923,412 | A | 5/1990 | Morris | |
| 5,281,167 | A | 1/1994 | Le et al. | |
| 5,509,821 | A | 4/1996 | Small et al. | |
| 5,576,675 | A | 11/1996 | Oldfield | |
| 5,785,554 | A | 7/1998 | Ohshiro | |
| 6,396,367 | B1 | 5/2002 | Rosenberger | |
| 6,802,739 | B2 | 10/2004 | Henningsen | |
| 6,824,415 | B2 | 11/2004 | Wlos | |
| 6,835,095 | B2 | 12/2004 | Chen | |
| 7,011,546 | B2 | 3/2006 | Vaccaro | |
| 7,077,700 | B2 | 7/2006 | Henningsen | |
| 7,104,839 | B2 | 9/2006 | Henningsen | |
| 7,121,883 | B1 | 10/2006 | Petersen et al. | |
| 7,144,272 | B1 | 12/2006 | Burris et al. | |
| 7,156,696 | B1 | 1/2007 | Montena | |
| 7,163,420 | B2 | 1/2007 | Montena | |
| 7,335,059 | B2 | 2/2008 | Vaccaro | |
| 7,381,089 | B2 | 6/2008 | Holser, Sr. | |
| 7,179,121 | B1 | 7/2008 | Burris et al | |
| 7,448,906 | B1 | 11/2008 | Islam | |
| 2005/0079761 | A1 * | 4/2005 | Rodrigues | 439/578 |

* cited by examiner

*Primary Examiner*—Tho D Ta
*Assistant Examiner*—Travis Chambers
(74) *Attorney, Agent, or Firm*—Babcock IP, PLLC

(57) ABSTRACT

A coaxial connector with a connector body provided with a connector body bore. The outer conductor electrically coupled to the connector body. An insulator supporting an inner contact coaxial with the connector body bore. A grip ring seated in an annular grip ring groove of the inner contact. The grip ring groove provided with a wedge surface having a taper between the connector end of the wedge surface and the cable end of the wedge surface. The grip ring movable along the wedge surface, longitudinally within the grip ring groove. The grip ring provided with a grip surface oriented to engage a surface area of the inner conductor as the inner contact is coupled with the inner conductor by insertion of the coaxial cable into the connector body bore. The grip surface dimensioned to couple with the surface area, inhibiting removal of the inner conductor towards the cable end.

18 Claims, 5 Drawing Sheets

INNER CONDUCTOR WEDGE ATTACHMENT COUPLING COAXIAL CONNECTOR

BACKGROUND

1. Field of the Invention

This invention relates to electrical cable connectors. More particularly, the invention relates to a coaxial cable connector with an inner conductor to inner contact longitudinal retention interconnection.

2. Description of Related Art

Coaxial cable connectors are used, for example, in communication systems requiring a high level of precision and reliability.

To create a secure mechanical and optimized electrical interconnection between the cable and the connector, prior coaxial connectors have utilized circumferential contact between a leading edge of the coaxial cable outer conductor and the connector body, such as a flared end of the outer conductor that is clamped against an annular wedge surface of the connector body, via a coupling nut. With the outer conductor mechanically secured, the inner conductor may be allowed to longitudinally float, electrically contacted by a bias-type contact mechanism such as spring fingers engaging the inner conductor along an outer diameter surface, or, if the inner conductor is hollow, along an inner sidewall of the inner conductor bore. Representative of this technology is commonly owned U.S. Pat. No. 5,795,188 issued Aug. 18, 1998 to Harwath.

Where the attached coaxial cable has an extended length, variances between the thermal expansion characteristics of the inner and outer conductor may become significant, resulting in unacceptable longitudinal movement of the inner conductor with respect to the inner contact. Also, longitudinal movement of the inner conductor with respect to the inner contact may introduce undesirable passive intermodulation (PIM) distortion.

Alternatively, prior connectors have provided mechanical interconnections between the inner conductor and the inner contact via a thread-driven radial expansion and/or direct threading of the inner contact into the bore of a hollow inner conductor. The threaded elements and/or screws required for these configurations may increase manufacturing costs and/or installation complexity.

Competition in the coaxial cable connector market has focused attention on improving electrical performance and minimization of overall costs, including materials costs, training requirements for installation personnel, reduction of dedicated installation tooling and the total number of required installation steps and/or operations.

Therefore, it is an object of the invention to provide a coupling nut that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
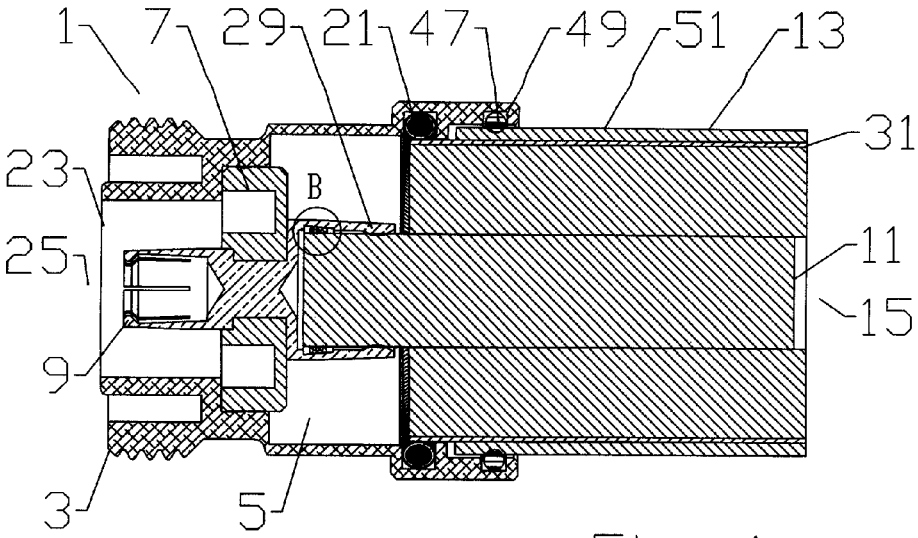
FIG. 1 is a schematic cross-section side view of a coaxial connector, according to a first exemplary embodiment, shown interconnected with a solid inner conductor coaxial cable.
Figure 2:
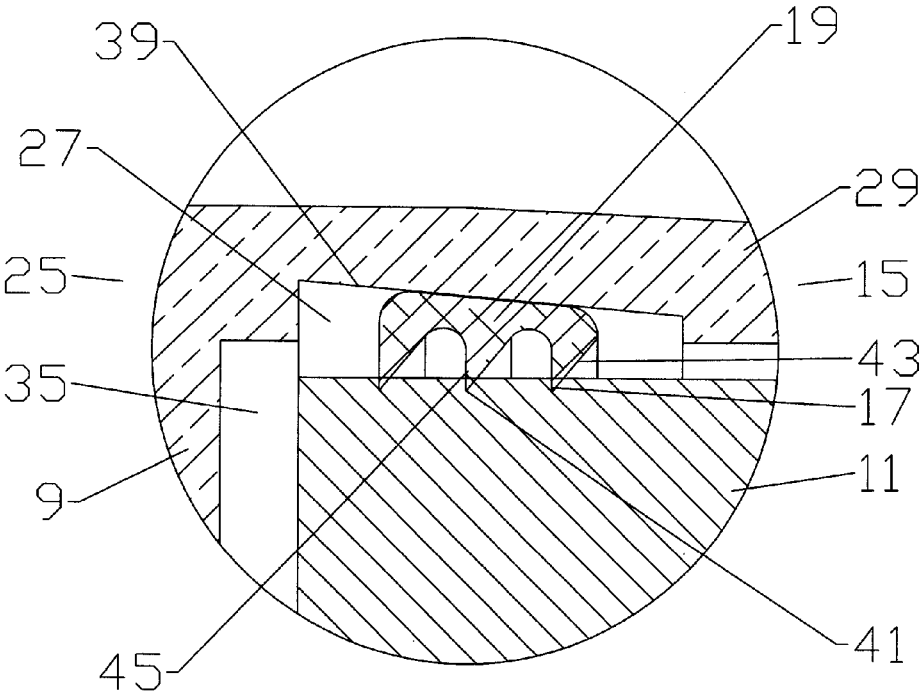
FIG. 2 is a close-up view of area B of FIG. 1.
Figure 3:
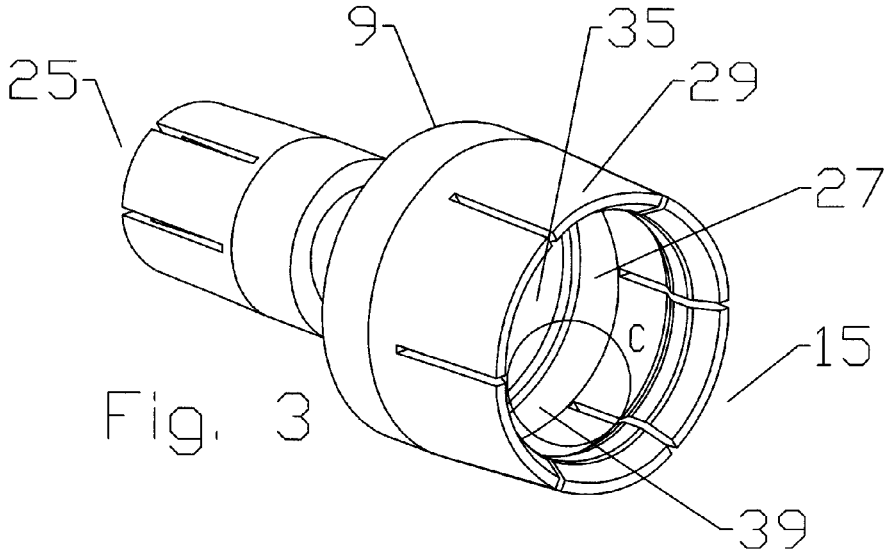
FIG. 3 is a schematic isometric view of the inner contact of the coaxial connector of FIG. 1.
Figure 4:
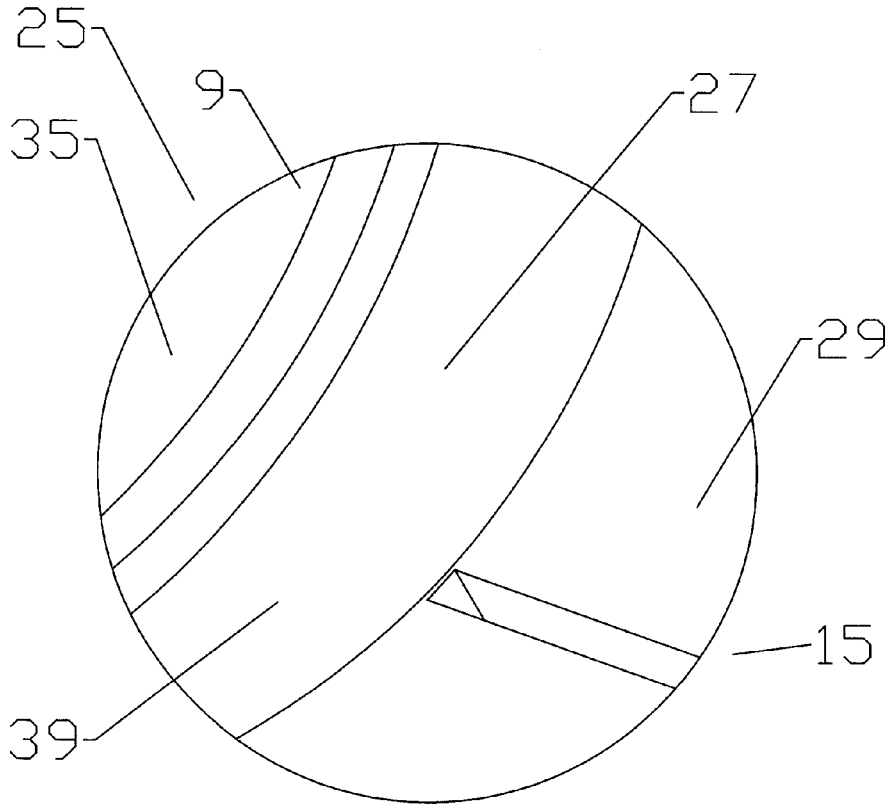
FIG. 4 is a close-up view of area C of FIG. 2.
Figure 5:
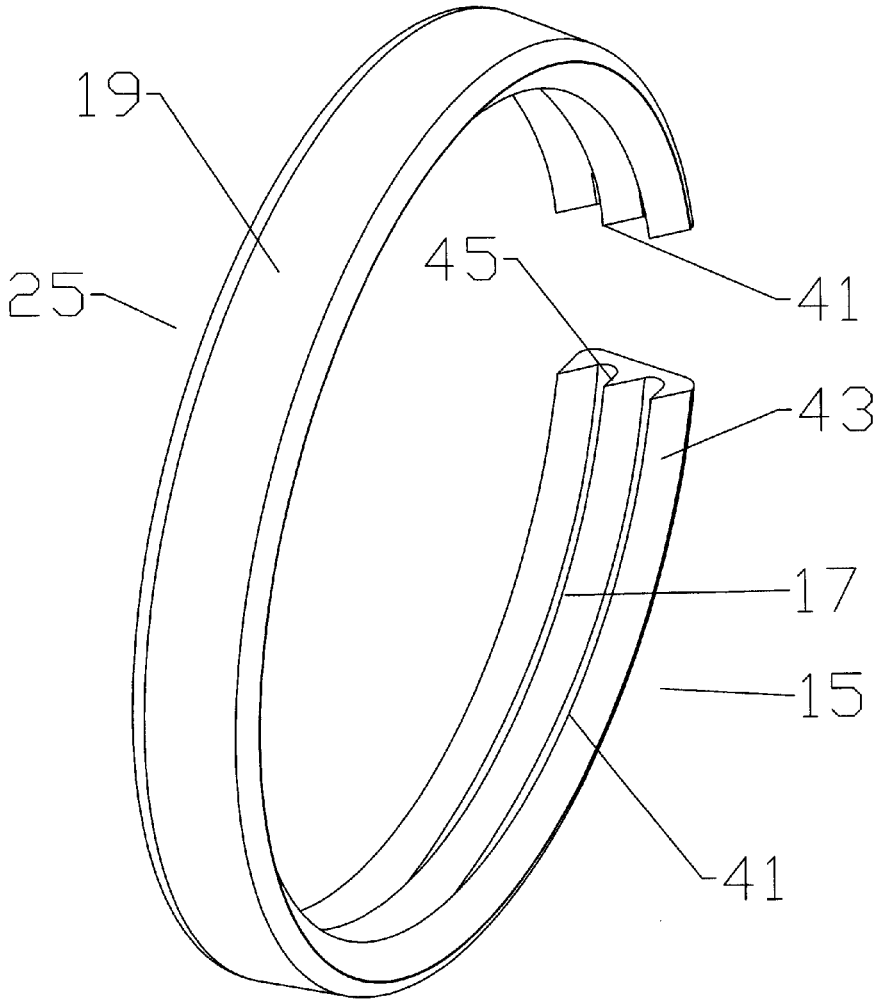
FIG. 5 is a schematic isometric view of the grip ring of FIG. 1.
Figure 6:
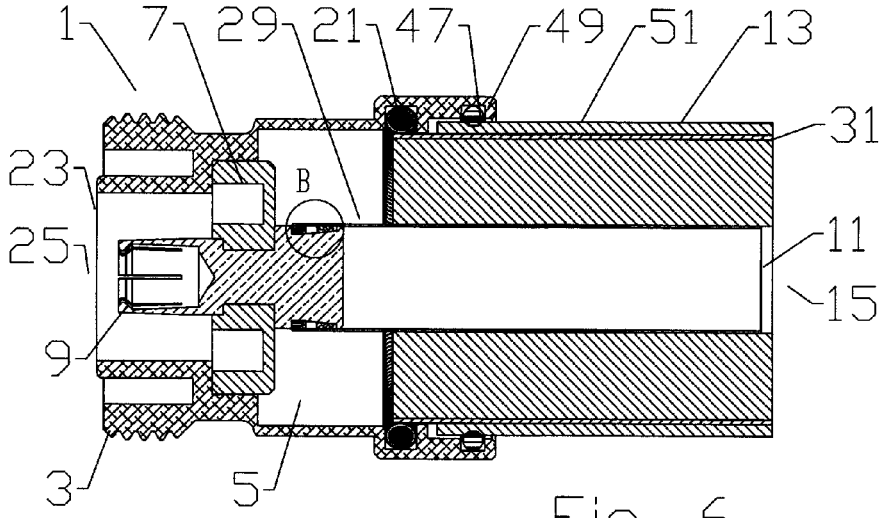
FIG. 6 is a schematic cross-section side view of a coaxial connector, according to an alternative exemplary embodiment, shown interconnected with a hollow inner conductor coaxial cable.

The inventor has analyzed available coaxial connector inner contact electro-mechanical interconnection configurations and recognized the drawbacks of threaded connection(s), and/or multiple step installation routines involving assembly of a plurality of discrete elements that together form the interconnection.

As shown in a first exemplary embodiment in FIGS. 1-5, a coaxial connector 1 according to the invention has a connector body 3 with a connector body bore 5. An insulator 7 seated within the connector body bore 5 supports an inner contact 9 coaxial with the connector body bore 5. The coaxial connector 1 mechanically retains the inner conductor 11 of a coaxial cable 13 inserted into the cable end 15 of the connector body bore 5 via a grip surface 17, best shown in FIG. 2, located on the inner diameter of a, for example c-shaped, grip ring 19 seated in a grip ring groove 27, best shown in FIG. 5. Electrical coupling and/or initial insertion alignment between the inner contact 9 and the inner conductor 11 may be supplemented by a plurality of inwardly biased spring fingers 29 extending from the cable end 15 of the inner contact 9, best shown in FIG. 3.

One skilled in the art will appreciate that the cable end 15 and the connector end 25 are descriptors used herein to clarify longitudinal locations and contacting interrelationships between the various elements of the coaxial connector 1. In addition to the identified positions in relation to adjacent elements along the coaxial connector 1 longitudinal axis, each individual element has a cable end 15 side and a connector end 25 side, i.e. the sides of the respective element that are facing the respective cable end 15 and the connector end 25 of the coaxial connector 1.

The grip ring 19 may be retained within the connector body bore 5, for example seated within a grip ring groove 27 provided in the sidewall of an inner contact bore 35 open to the cable end 15. As best viewed in FIG. 4, an annular wedge surface 39 within the grip ring groove 27 has a taper between a maximum diameter at a connector end 25 side and a minimum diameter at a cable end 15 side. An outer diameter of the grip ring 19 contacts the wedge surface 39 and is thereby driven radially inward into progressively increased gripping engagement with the inner conductor 11 during longitudinal travel along the wedge surface 39 toward the cable end 15.

The contact between the outer diameter of the grip ring 19 and the wedge surface 39 may be along a corner of the grip ring 19 that may be rounded to promote smooth travel therealong, or alternatively the grip ring 19 may be formed with an extended contact area between the grip ring 19 and the wedge surface 39 by angling the outer diameter profile of the grip ring 19 to be parallel to the taper of the wedge surface 39.

The grip ring 19 is preferably formed from a material, such as stainless steel or beryllium copper alloy, with a hardness characteristic greater than the material of the inner conductor 11, to enable the grip surface 17 to securely engage and grip the outer diameter of the inner conductor 11. The grip surface 17 of the grip ring 19 has a directional bias, engaging and gripping the outer diameter surface of the inner conductor 11 when in tension towards the cable end 15 while allowing the inner conductor 11 to slide past the grip surface 17 when moved towards the connector end 25. The grip surface 17 may be formed as a plurality of annular or helical grooves or barb(s) 41 provided with an angled face 43 extending from a groove bottom on the cable end 15 to a groove top on the connector end 25 of each groove and/or barb 41, best shown in FIG. 5. A stop face 45 opposite the angled face 43 may be a vertical face with respect to the coaxial connector 1 longitudinal axis and/or the stop face 45 may be angled towards the connector end 25 to present a barb point to gouge into and retain the inner conductor 11 when travel is attempted in the direction out of the connector body bore 5 towards the cable end 15.

Referring again to FIG. 2, the grip ring 19 has a range of longitudinal movement within the grip ring groove 27. As the grip ring 19 moves along the wedge surface 39 towards the connector end 25, for example as the leading edge of the inner conductor 11 is inserted into the connector body bore 5 from the cable end 15 and contacts the angled face(s) 49 of the grip surface 17, the grip ring 19 will either spread to allow the inner conductor 11 to pass through, or will also begin to move longitudinally towards the connector end 25, within the grip ring groove 27. Because of the wedge surface 39 taper, as the grip ring 19 moves towards the connector end 25, the depth of the grip ring groove 27 with respect to the grip ring 19 increases. Thereby, the grip ring 19 may be spread radially outward to enable the passage of the inner conductor 11 through the grip ring 19 and towards the connector end 25. Conversely, once spread, the bias of the grip ring 19 inward towards its relaxed state creates a gripping engagement between the grip surface 17 and the surface area to be coupled with, here the outer diameter surface of the inner conductor 11. If tension is applied between the connector body 3 and the coaxial cable 13 to pull the inner conductor 11 toward the cable end 15, the grip ring 19 is driven against the tapered wedge surface 39, progressively decreasing the depth of the grip ring groove 27, thereby driving the grip ring 19 radially inward and further increasing the gripping engagement as grip surface 17 is driven into the outer diameter surface of the inner conductor 11. A cable end 15 grip ring groove 27 sidewall may be dimensioned to be at a position where the grip ring 19 diameter relative to the inner conductor 11 diameter is configured for the grip surface 17 to have securely engaged the inner conductor 11 but which is short of the grip ring 19 radial inward movement from causing the inner conductor 11 to collapse radially inward.

Electrical coupling between the connector body 5 and the outer conductor 31 is demonstrated in FIG. 1 as an outer conductor contact 21 seated within the connector body bore 5 that makes circumferential contact with the outer conductor 31, electrically coupling the outer conductor 31 across the connector body 3 to a connector interface 23 at the connector end 25. The connector interface 23 may be any desired standard or proprietary interface. Alternatively, the electrical coupling between the outer conductor 31 and the connector body 3 may be provided also in the form of a rigid mechanical connection, such as a clamp, interference fit and/or crimp connection as is well known in the coaxial connector art.

The outer conductor contact 21 may be any conductive structure with a spring characteristic, such as a helical coil spring, seated in a spring groove of the connector body bore 5 sidewall or other retaining/seating feature.

A jacket seal 47 may be provided in a jacket groove 49 proximate the cable end 15 of the coaxial connector 1. The jacket seal 47 is dimensioned to seal between the connector body bore 5, and a jacket 51 of the outer conductor 31. Alternatively, for example where no jacket 51 is present, the jacket seal 47 may alternatively be configured to seal against the outer conductor 31.

Figure 7:
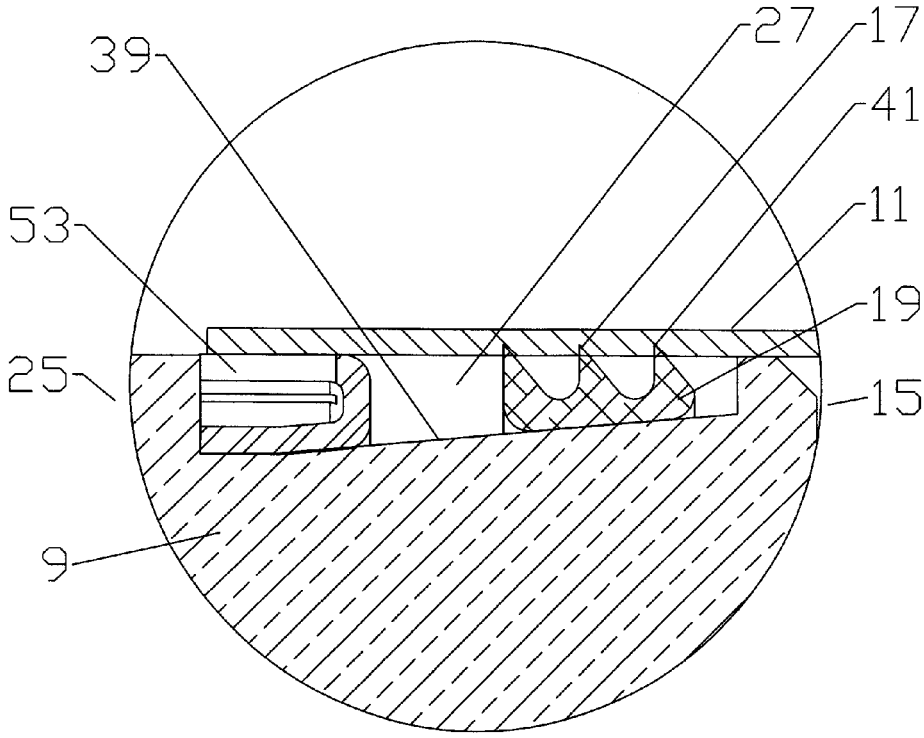
FIG. 7 is a close-up view of area B of FIG. 6.
Figure 8:
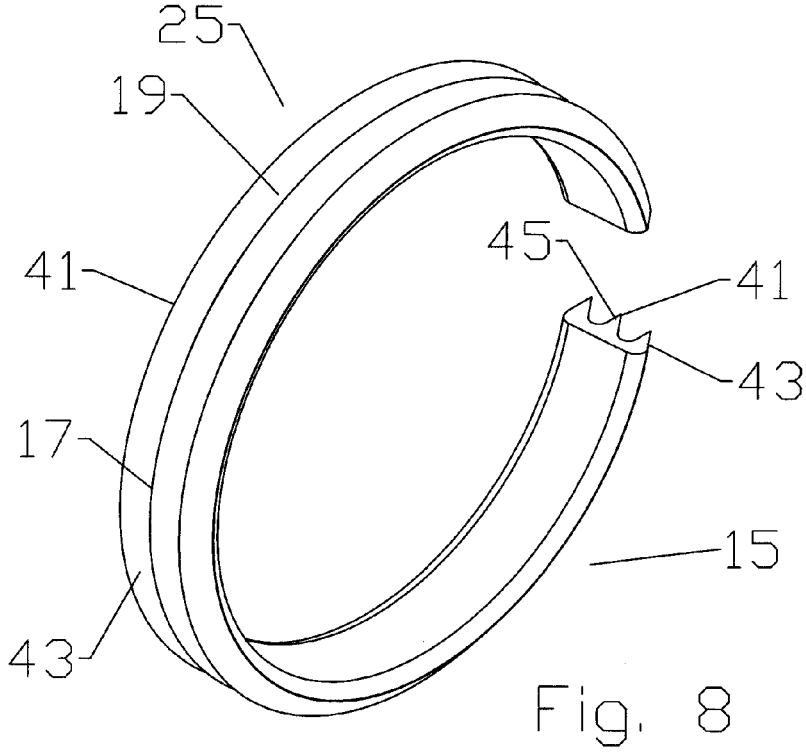
FIG. 8 is an isometric view of the grip ring of FIG. 6.

In alternative embodiments, for example as shown in FIGS. 6-9, the inner contact 9 may be adapted to couple with a coaxial cable 13 configuration that has a hollow inner conductor 11. To enable electro-mechanical interconnection between a bore sidewall of the inner conductor 11 and the inner contact 9, features of the inner contact 9, grip ring groove 27 and grip ring 19 are reversed, as best shown in FIG. 7.

Figure 9:
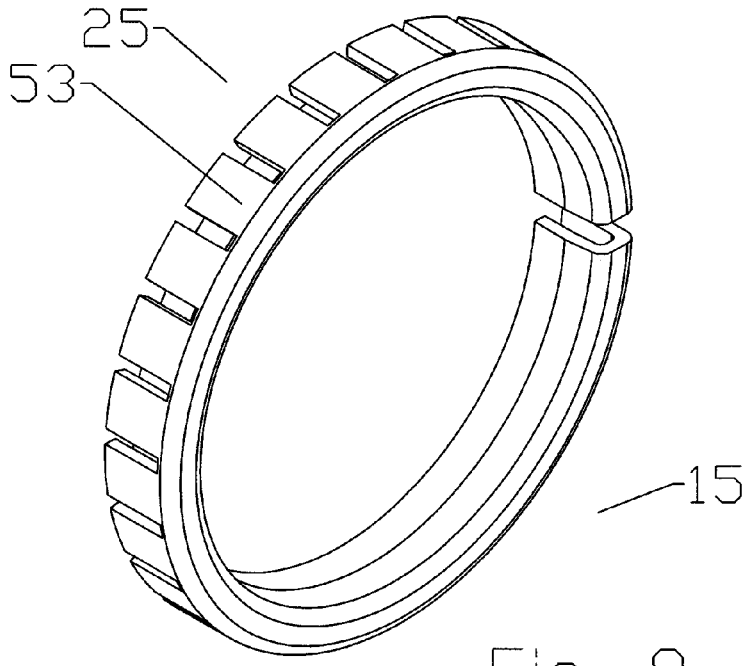
FIG. 9 is an isometric view of the inner conductor contact of FIG. 6.

In this embodiment, the inner contact 9 is dimensioned to insert within the bore of the inner conductor 11, the grip ring groove 27 is formed in an outer diameter surface of the inner contact 9, with the wedge surface 39 tapering between a minimum outer diameter at the connector end 25 and a maximum diameter at the cable end 15. The grip ring 19 has the grip surface 17 on the outer diameter, best shown on FIG. 8. To enhance the electrical interconnection, an inner conductor contact 53, for example as shown in FIG. 9, may be seated on the inner contact 9, dimensioned to bias between the inner contact 9 and the sidewall of the bore of the inner conductor 9.

One skilled in the art will appreciate the significant manufacturing and installation benefits of the present invention. During manufacturing, a complete coaxial connector 1 assembly ready for installation is prepared with a minimal total number of required elements. Further, the various environmental seals, such as jacket seal 43, may be each overmolded upon the respective groove(s) to provide a single assembly with integral environmental seals.

To install the coaxial connector 1 upon a coaxial cable 13, the coaxial cable end is stripped back to expose desired lengths of the conductor(s) and the stripped coaxial cable end inserted into the cable end 15 of the connector body bore 5 until bottomed. A test tension between the connector body 3 and the coaxial cable 1 may be applied to verify secure engagement between the grip ring 19 and the inner conductor 11.

In the embodiments herein above, the prior manual cable end flaring operations and any required disassembly/reassembly of the various connector elements proximate the cable end 15 during coaxial cable 13 to coaxial connector 1 interconnection have been eliminated. One skilled in the art will appreciate that a coaxial connector 1 according to the invention enables use of coaxial cable(s) 13 with an outer conductor 31 with substantially reduced tension strength requirements, such as metal foil, metallic coated surfaces or the like as the tension strength requirements for the cable may be alternatively substantially provided by the inner conductor 11, interconnected with the coaxial connector 1 according to the invention. Alternatively, when applied to a coaxial connector 1 configuration also including a traditional mechanical interconnection between the outer conductor 31 and the connector body 5, the resulting interconnection may provide improved levels of tension failure resistance.

| Table of Parts | |
|---|---|
| 1 | coaxial connector |
| 3 | connector body |
| 5 | connector body bore |
| 7 | insulator |
| 9 | inner contact |
| 11 | inner conductor |
| 13 | coaxial cable |
| 15 | cable end |
| 17 | grip surface |
| 19 | grip ring |
| 21 | outer conductor contact |
| 23 | connector interface |
| 25 | connector end |
| 27 | grip ring groove |
| 29 | spring finger |
| 31 | outer conductor |
| 39 | wedge surface |
| 35 | inner contact bore |
| 39 | wedge surface |
| 41 | barb |
| 43 | angled face |
| 45 | stop face |
| 47 | jacket seal |
| 49 | jacket groove |
| 51 | jacket |
| 53 | inner conductor contact |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

I claim:

1. A coaxial connector with a connector end and a cable end for coupling with an inner conductor and an outer conductor of a coaxial cable, the connector comprising:

a connector body provided with a connector body bore along a longitudinal axis;

an electrical coupling between the outer conductor and the connector body;

an insulator supporting an inner contact coaxial with the connector body bore;

a grip ring seated in an annular grip ring groove of the inner contact; the grip ring groove provided with a wedge surface having a taper between a connector end of the wedge surface and a cable end of the wedge surface; the grip ring movable, along the wedge surface, longitudinally within the grip ring groove;

the grip ring provided with a grip surface oriented to engage a surface area of the inner conductor as the inner contact is coupled with the inner conductor by insertion of the coaxial cable into the connector body bore; the grip surface dimensioned to couple with the surface area, inhibiting removal of the inner conductor towards the cable end.

2. The connector of claim 1, wherein the grip surface is a plurality of annular barbs; the annular barbs presenting an angled face to the grip ring cable end and a vertical face to the grip ring connector end.

3. The connector of claim 1, wherein the electrical coupling is a outer conductor contact seated in a sidewall of the connector body bore; the outer conductor contact dimensioned to bias between the connector body bore and the outer conductor.

4. The connector of claim 3, wherein the outer conductor contact is a circular coil spring.

5. The connector of claim 1, wherein the surface area of the inner conductor is an outer diameter of the inner conductor;

the grip ring groove is provided on a sidewall of an inner conductor bore of the inner contact; and the grip surface is provided on an inner diameter of the grip ring.

6. The connector of claim 5, further including a plurality of spring fingers extend from the cable end of the inner contact.

7. The connector of claim 5, wherein the taper decreases the inner diameter of the grip ring groove between the connector end of the wedge surface and the cable end of the wedge surface.

8. The connector of claim 1, wherein the surface area of the inner conductor is a sidewall of a bore of the inner conductor;

the grip ring groove is provided on an outer diameter of the inner contact; and the grip surface is provided on an outer diameter of the grip ring.

9. The connector of claim 8, further including an inner contact spring; the inner contact spring seated on an outer diameter of the inner contact; the inner contact spring dimensioned to bias between the inner contact and the sidewall of the bore of the inner conductor.

10. The connector of claim 8, wherein the taper increases the outer diameter of the grip ring groove between the connector end of the wedge surface and the cable end of the wedge surface.

11. A coaxial connector with a connector end and a cable end for coupling with an inner conductor and an outer conductor of a coaxial cable, the connector comprising:

a connector body provided with a connector body bore along a longitudinal axis;

an electrical coupling between the outer conductor and the connector body;

an insulator supporting an inner contact coaxial with the connector body bore;

a plurality of inwardly biased spring fingers extend from the cable end of the inner contact;

an annular grip ring groove provided on a sidewall of an inner conductor bore of the inner contact;

the grip ring groove provided with a wedge surface having a taper decreasing an inner diameter of the wedge surface between a connector end of the wedge surface and a cable end of the wedge surface;

a grip ring seated in the grip ring groove;

the grip ring movable, along the wedge surface, longitudinally within the grip ring groove;

the grip ring provided with a grip surface on an inner diameter of the grip ring;

the grip surface oriented to engage an outer diameter of the inner conductor as the inner contact is coupled with the inner conductor by insertion of the coaxial cable into the connector body bore;

the grip surface dimensioned to couple with the outer diameter of the inner conductor, inhibiting removal of the inner conductor towards the cable end.

12. The connector of claim 11, wherein the grip surface is a plurality of annular barbs; the annular barbs presenting an angled face to the grip ring cable end and a vertical face to the grip ring connector end.

13. The connector of claim 11, wherein the electrical coupling is a outer conductor contact seated in a sidewall of the connector body bore; the outer conductor contact dimensioned to bias between the connector body bore and the outer conductor.

14. The connector of claim 13, wherein the outer conductor contact is a circular coil spring.

15. A coaxial connector with a connector end and a cable end for coupling with an inner conductor and an outer conductor of a coaxial cable, the connector comprising:

a connector body provided with a connector body bore along a longitudinal axis;

an electrical coupling between the outer conductor and the connector body;

an insulator supporting an inner contact coaxial with the connector body bore;

an inner contact spring seated on an outer diameter of the inner contact; the inner contact spring dimensioned to bias between the inner contact and a bore sidewall of the inner conductor;

an annular grip ring groove provided on an outer diameter of the inner contact;

the grip ring groove provided with a wedge surface having a taper increasing an outer diameter of the wedge surface between a connector end of the wedge surface and a cable end of the wedge surface;

a grip ring seated in the grip ring groove, the grip ring movable, along the wedge surface, longitudinally within the grip ring groove;

the grip ring provided with a grip surface on an outer diameter of the grip ring;

the grip surface oriented to engage the bore sidewall of the inner conductor as the inner contact is coupled with the inner conductor by insertion of the coaxial cable into the connector body bore;

the grip surface dimensioned to couple with the bore sidewall, inhibiting removal of the inner conductor towards the cable end.

16. The connector of claim 15, wherein the grip surface is a plurality of annular barbs; the annular barbs presenting an angled face to the grip ring cable end and a vertical face to the grip ring connector end.

17. The connector of claim 15, wherein the electrical coupling is an outer conductor contact seated in a sidewall of the connector body bore; the outer conductor contact dimensioned to bias between the connector body bore and the outer conductor.

18. The connector of claim 17, wherein the outer conductor contact is a circular coil spring.

* * * * *